US006494762B1

(12) United States Patent
Bushmitch et al.

(10) Patent No.: US 6,494,762 B1
(45) Date of Patent: Dec. 17, 2002

(54) PORTABLE ELECTRONIC SUBSCRIPTION DEVICE AND SERVICE

(75) Inventors: Dennis Bushmitch, Somerset, NJ (US); David Braun, Denville, NJ (US); Sarit Mukherjee, Mt. Laurel, NJ (US); Robert Fish, Gillette, NJ (US)

(73) Assignee: Matsushita Electrical Industrial Co., Ltd., Osaka (JP)

( * ) Notice: Subject to any disclaimer, the term of this patent is extended or adjusted under 35 U.S.C. 154(b) by 0 days.

(21) Appl. No.: 09/540,970

(22) Filed: Mar. 31, 2000

(51) Int. Cl.[7] ..... A63H 3/00

(52) U.S. Cl. ..... 446/268; 463/42; 463/1; 434/307 R

(58) Field of Search ..... 463/1, 30, 31, 463/35, 36, 39, 40, 42; 434/307 R, 308, 309; 446/298, 297, 268, 300, 301, 299, 175, 401, 405; 345/473, 474; 340/825.06, 825.07, 825.08; 901/1

(56) References Cited

U.S. PATENT DOCUMENTS 5,048,831 A * 9/1991 Sides
5,166,886 A * 11/1992 Molnar et al.
5,181,107 A * 1/1993 Rhoades
5,497,479 A * 3/1996 Hornbuckle
5,592,537 A * 1/1997 Moen
5,624,316 A * 4/1997 Roskowski et al.
5,632,681 A * 5/1997 Bakoglu et al.
5,654,746 A * 8/1997 McMullan, Jr. et al.
5,697,829 A * 12/1997 Chainani et al.
5,775,994 A * 7/1998 Hsu
5,791,992 A * 8/1998 Crump et al.
5,971,855 A 10/1999 Ng
5,977,951 A * 11/1999 Danieli et al.
5,983,073 A 11/1999 Ditzik
6,022,273 A * 2/2000 Gabai et al.
6,027,024 A 2/2000 Knowles
6,029,046 A * 2/2000 Khan et al.
6,224,486 B1 * 5/2001 Walker et al.

OTHER PUBLICATIONS

Giga Fighters, Warrior Registration, http://www.virtualpet-.com/vp/farm/gigapet/1998gpl/1998gpl.htm.
1998 Giga Pet Product Line As Announced Feb. 1998, http://www.virtualpet.com/vp/farm/gigapet/1998gpl.htm.
Vision of the Future Philips Corporate Design, *http://ww-w.design.philips.com/vof/vofsite5/vof5lev2/shiv2/shiv2.htm.*
Virtual Friend, *http://www.haptek.com/downloads/vf2aobut.shtml.*
Talk to Me, http://www.talk–to–me.net.

* cited by examiner

*Primary Examiner*—Michael O'Neill
(74) *Attorney, Agent, or Firm*—RatnerPrestia

(57) ABSTRACT

A portable computer is configured to receive programming that is automatically updated by a subscription service. The portable computer includes a facility to connect to one or more subscription services on or through a host computer. The portable computer identifies itself to the subscription service and automatically receives updates for any services registered to it. A log file records information and stimuli received by the portable computer. The subscription service uses the log file to update subscriptions. One embodiment of the portable computer is configured to fit within a shell representing a character or object associated with a subscription. The portable computer may include one or more interface ports allowing the portable computer receive stimulus from sensors in the shell and or to activate transducers in the shell. In one embodiment of the invention, the portable computer is coupled to a cellular telephone.

15 Claims, 8 Drawing Sheets

PORTABLE ELECTRONIC SUBSCRIPTION DEVICE AND SERVICE

BACKGROUND OF THE INVENTION

The present invention relates to portable computing devices and in particular to a portable computing device which is configured to automatically download information from an electronic subscription service.

Electronic pets such as Tamagotchi devices have been on the market for several years. These virtual pets live a virtual life in a small form factor computer. They tend to force a level of interaction with their owners by demanding to be fed, exercised or entertained. Their owners satisfy the demands of their "pets" by pressing buttons on the small computer. Even today, children and many adults can be found carrying around their favorite electronic animal, be it a dog, a bird or a "pocket monster."

U.S. Pat. No. 5,971,855 to Ng entitled APPARATUS AND METHOD OF COMMUNICATING BETWEEN ELECTRONIC GAMES describes an electronic game apparatus that is preprogrammed to simulate a pet, a fighter or a farm with a set of farm animals. The game devices described in this patent may be linked to each other for interactive play or may be linked to an internet web site via a serial port connected to a personal computer.

When they are linked to a the personal computer, the preprogrammed game may be updated or modified by downloading data from the web site using the personal computer. For example a pet who has "died" due to lack of care from the owner may be revived. In addition, a pet or fighter may receive "training" to allow it to compete better with other pets or fighters in play between two game units.

Although the web-site linkage allows a user to update or slightly modify the preprogrammed game, the basic premise of the game can not be changed. Consequently, after a period of time, the user may become bored with the game and cease to use the device.

Other types of portable electronic devices exist such as personal digital assistants (PDAs). These devices are typically much more robust in their processing capabilities than the hand-held games described above. A typical PDA includes a small computer having a processor (e.g. a Motorola 68328 microprocessor), a memory (e.g. 10 megabyte random access memory (RAM)), a touch-sensitive liquid crystal display, input buttons and a speaker. The computer is controlled by an operating system, for example the Palm™ OS 3.0 for the Palm Computing™ PDA.

The operating systems for some PDAs include data communications facilities that are compatible with a global information network (e.g. the Internet). The PDAs made by Palm Computing, for example, include program code that receives and transmits messages in TCP/IP format. Personal digital assistants having this capability may connect to an internet service provider directly through a modem, without needing to be connected through a host computer. Currently, PDAs may be connected to the global information network via special internet service providers that provide access to web sites having much of the same information that is available at a conventional web site but in a format more appropriate for the small screen of a PDA. This information includes, for example, stock quotes, news reports and weather forecasts.

This type of hand-held connectivity is not limited to PDAs. The current generation of digital cellular telephones also connects to special web pages on the global information network. These web pages are specially formatted for the cellular telephone and allow a user to request specific information. Responsive to the request, the information is sent to the telephone where it may be viewed by scrolling the display using, for example, up and down menu control buttons on the cellular telephone.

Both cellular telephones and PDAs also have games. In PDAs, at least, the games may be downloaded from the global information network. As with the system described in the above-referenced patent, however, these games may be downloaded only by connecting the PDA to another computer. In addition, each game operates according to a fixed program eventually causing the user to become bored and seek another game.

SUMMARY OF THE INVENTION

The present invention is embodied in a portable hand-held computer configured to be coupled to a remote computer to receive a subscription service.

The exemplary portable computer includes a facility to connect to one or more subscription services. The portable computer identifies itself to the site and automatically receives updates for any services with which it is registered.

According to one aspect of the invention, the portable computer includes a log file that records information entered into the portable computer since the last connection. The subscription service reads the log file and uses the information to update subscriptions.

According to another aspect of the invention, the portable computer is configured to fit within a shell, the shell representing a character or object associated with one or more of the subscriptions.

According to yet another aspect of the invention the portable computer includes at least one interface port that mates with a corresponding interface port in the shell, the interface port allowing the portable computer to receive sensor input from, or provide control signals to the shell.

According to another aspect of the invention, the portable computer is coupled to a cellular telephone and the subscription service is automatically accessed so when the cellular telephone is registered with the network.

According to another aspect of the invention, the subscription service is one of a comic strip, a virtual pet, a puzzle, a continuing narrative, and an interactive narrative.

BRIEF DESCRIPTION OF THE DRAWINGS

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures.

DETAILED DESCRIPTION

Figure 1:
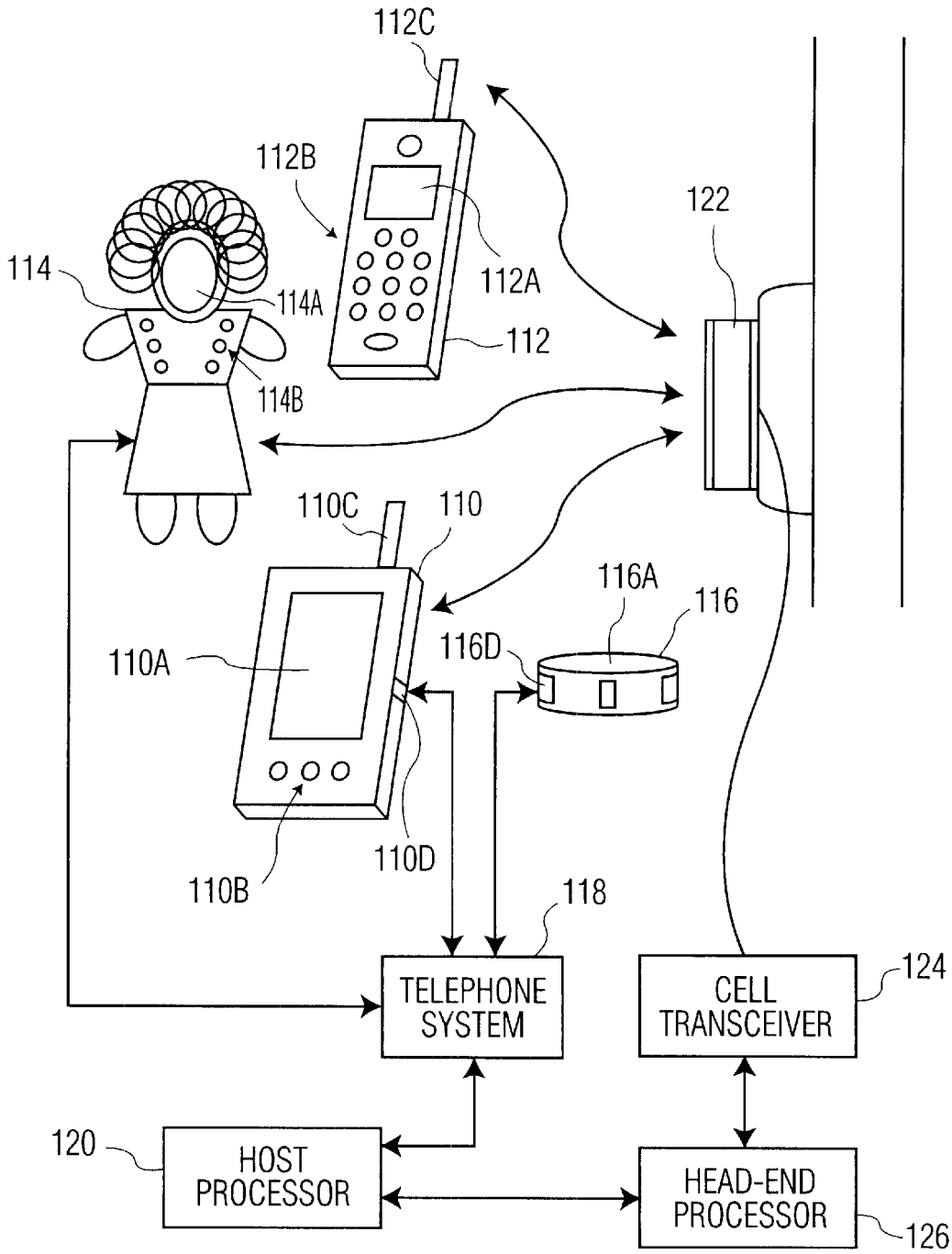
FIG. 1 is a block diagram, partly in isometric diagram form which illustrates multiple exemplary embodiments of the invention.

FIG. 1 is a block diagram, partly in schematic diagram form showing several portable computers and a computer system that, with the portable computers, implements the subscription service. The portable computers include a PDA 110, a cellular telephone 112, a programmable doll 114, and a programmable computing module 116. The use and structure of the module is described below with reference to FIGS. 2A through 2C.

The exemplary PDA 110 includes a display screen 110A, control buttons 110B, an antenna 110C and a telephone jack 110D. Details of the internal structure of the PDA 110 are described below with reference to FIG. 3. The exemplary PDA 10 may be connected to a web page, bulletin board or other facility that provides the subscription service either through a cellular communications link using the antenna 110C, to send signals to and receive signals from a cellular antenna 122 that is connected to a cell transceiver 124. The cell transceiver, in turn, is connected to a headend processor 126 of the cellular communications network. The processor 126 is coupled to the hostcomputer 120 that may include the web pages to be accessed by the portable computer 110 or may be an global information network service provider that allows a minimal browser implemented in the cellular telephone computer 110 to access web sites through the global information network (not shown). In the exemplary embodiment of the invention, the term cellular includes both analog and digital wireless telephone technologies. Alternatively, the PDA 110 may connect to the host computer 110 through the telephone system 118 via the telephone jack 110D of the PDA 110.

The internal structure of a cellular telephone portable computer 112 suitable for use with the present invention is described below with reference to FIG. 4. Referring to FIG. 1, this exemplary portable computer includes a display 112A, control buttons 112B and an antenna 112C. The exemplary cellular telephone portable computer 112 connects to the host computer 120 through its antenna 112C, the cellular antenna 122, the cell transceiver 124 and the headend processor 126. As with the PDA 110, the cellular telephone 112 may access the subscription services through web pages or bulletin boards maintained on the host computer 120 or it may use the host computer 120 as a server on the global information network to access subscription services on other computers connected to the host computer 120 via the global information network.

Also shown in FIG. 1 is a programmable doll 114. The doll includes a display device 114A that, in this exemplary embodiment of the invention, forms the doll's face. The doll 114 also includes, control buttons 114B and a telephone connection jack (not shown). The doll may also include a cellular antenna (not shown) through which the doll may connect to the host computer 120 through the cellular communications system. The exemplary programmable doll may have the same internal structure as the PDA 110. In the exemplary embodiment of the invention, the program controlling the doll 114 may change as one example of a subscription service according to the subject invention. The program may be updated to allow the doll to "grow" with corresponding changes in the face that is displayed on the display device 114A or it may be changed entirely. One exemplary doll subscription service may be to program the doll to represent a child from a different country each month.

The final portable computer shown in FIG. 1 is a modular portable computer 116. This computer is shown in greater detail in FIGS. 2A through 2C, below. The modular portable computer 116 includes a display 116A and a telephone jack 116D. This exemplary modular computer connects to the host computer 120 via the telephone jack 116D and telephone system 118. As with the other embodiments of the invention, the subscription service may be implemented in the computer 120 or in a remote computer (not shown) that is coupled to the host computer 120 via the global information network (not shown).

The modular portable computer 116 may be used to implement a variety of subscription services as described below. This computer is intended to be inserted into a shell. Different shells may be used for different subscription services. For example, the module 116 may be inserted, for example, into a plush animal or robot to implement a virtual pet subscription or into a space ship to implement a space toy subscription. All of the portable computers shown in FIG. 116 are desirably implemented to withstand a certain level of rough handling. This is especially true for any device that is meant to be used by a child.

Figure 2A:
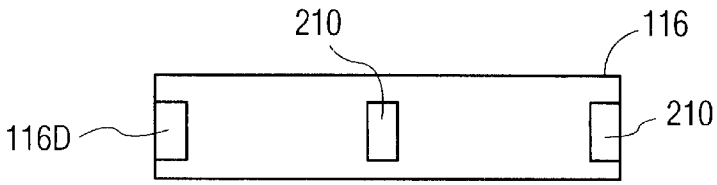
FIG. 2A is a side plan view of one embodiment of the invention shown in FIG. 1.

FIG. 2A is a side plan view of the modular portable computer 116. As shown in FIG. 2A, the portable computer 116 includes a telephone jack 116D and several auxiliary connectors 210. The connectors 210 may be used to connect the module 116 to one or more input and/or output transducers (not shown) in the shell.

Figure 2B:
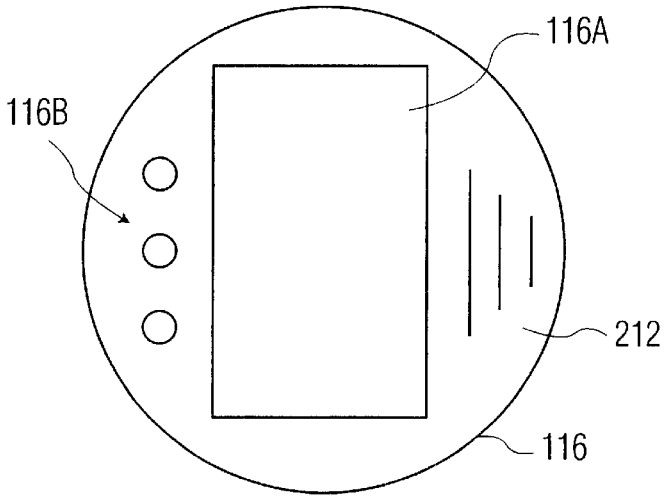
FIG. 2B is a top plan view of the embodiment of the invention shown in FIG. 2A.
Figure 2C:
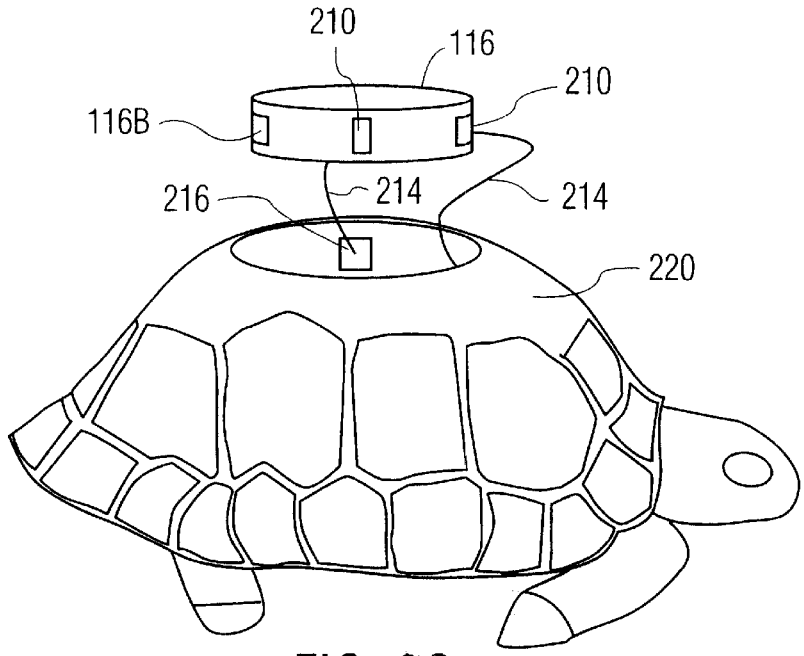
FIG. 2C is a perspective drawing that illustrates an exemplary use of the embodiment of the invention shown in FIGS. 2A and 2B.

FIG. 2B is a top plan view of the modular portable computer 116 shown in FIG. 2A. As shown in FIG. 2B, the portable computer 116 includes a display panel 116A, control buttons 116B, and a speaker 212. FIG. 2C shows how the modular portable computer 116 may be used to implement a virtual pet. In this example, the shell is a robot turtle 220. In the exemplary embodiment of the invention, the shell 220 may include multiple transducers (not shown) that connect to the module 116 via internal connection ports 216 via flexible cables 214. These transducers may include, for example, pressure sensors (not shown) in the turtle's nose, light sensors (not shown) in the eyes and/or one or more motors that cause the turtles legs to move. A turtle subscription may, for example, cause the robot 220 to move slowly forward when one of the control buttons 116B is pressed, until the pressure sensor in the nose is activated. At this point, the module may emit a sound (e.g. "ouch"), turn the turtle to the right and start moving forward again.

As described below, The module may include a log file that records stimuli applied to the output transducers and signals received from the input transducers. This log may be up-loaded to the subscription service to change the way in which the module controls the robot. For example, if the log indicates that the light transducer has not been active, indicating that the robot is not used in bright-light environments, the subscription service may program the module to make noises indicating discomfort when the robot is exposed to bright lights.

Figure 3:
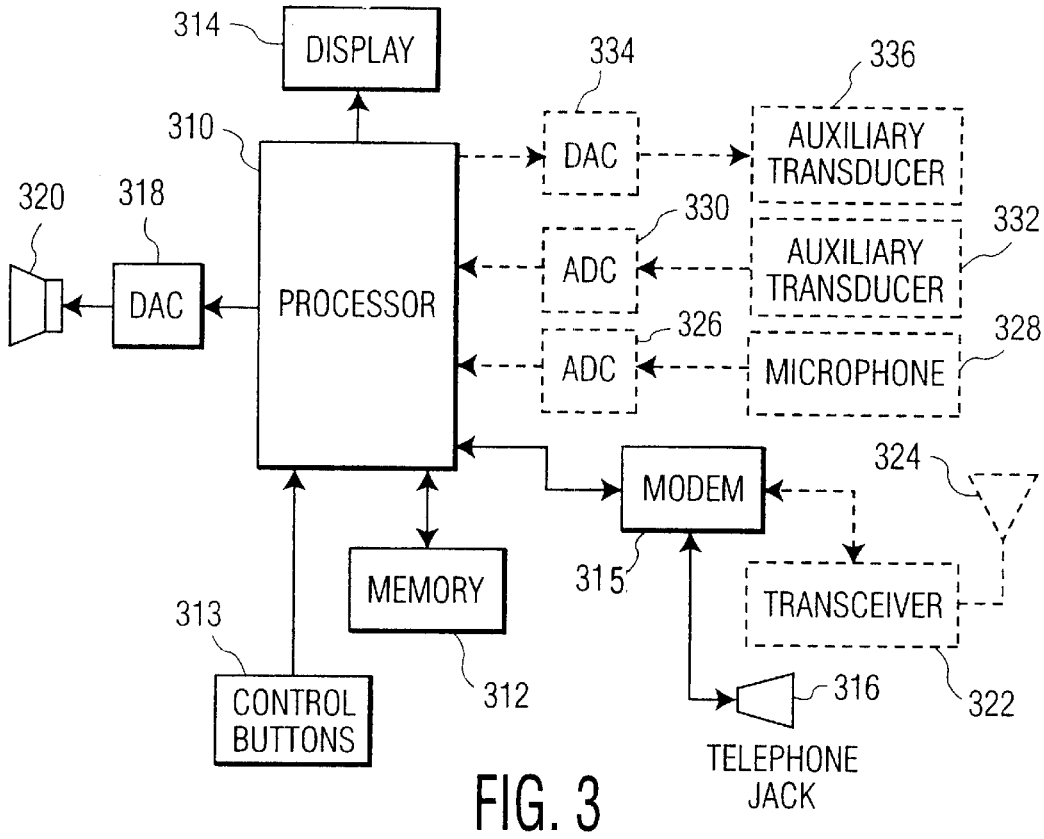
FIG. 3 is a functional block diagram of a portable computer that may be used in some of the embodiments of the invention shown in FIG. 1.

FIG. 3 is a functional block diagram of an exemplary portable computer according to the present invention. This computer may be used, for example, in the PDA 110, programmable doll 114 or modular portable computer 116, all shown in FIG. 1. The exemplary computer includes a processor 310, a memory 312 and a display device 314. The display device may be, for example, a back-lit liquid crystal device (LCD) display. It is contemplated, however, that other types of display devices such as electroluminescent displays, field emissive displays and organic or inorganic light emitting diode displays may be used instead of the LCD display.

The processor is coupled to receive input signals from control buttons 313. These buttons may include, for example, a power button, a menu/menu select button and one or more menu scrolling buttons. Alternatively, the only button 313 may be a power button and the entire control function for the device may be implemented through a touch sensitive display such as a capacitive or pressure sensitive display device (not shown).

The processor 310 is coupled to a modem 315 in order to dial an access number that connects the portable computer to the host computer 120 and to send data communications signals to the computer 120 in order to access the subscription service. As set forth above, the portable computer may also connect to the host computer 120 via a cellular communications link. In this instance, the portable computer may have a cellular transceiver 322 and an antenna 324 (both shown in phantom).

The exemplary portable computer shown in FIG. 3 also includes a digital to analog converter (DAC) 318, that is coupled to an output port of the processor 310, and a speaker 320 that is connected to the DAC 318. The speaker 320 may be coupled to the DAC 318 via sound signal processing circuitry such as an analog amplifier (not shown). Using the DAC 318, and speaker 320, the processor may cause the portable computer to provide recorded or synthesized speech, music or sound effect noises.

In addition to the control buttons 313 and the speaker 320, the portable computer may have other transducers, for example a microphone 328, and various auxiliary input transducers 332 and output transducers 336 (all shown in phantom). Each of the input transducers may be coupled to the processor 310 via a respective analog to digital converter (ADC) 326, 330 (shown in phantom) and the output transducers may be coupled to the processor 310 via a DAC 334 (shown in phantom). Auxiliary input transducers may include, for example, devices that sense light, pressure, moisture or heat. Auxiliary output transducers may include, for example, motors, discrete light emitting diodes (LEDs) or heating elements that, for example, may heat an odor producing substance to cause the portable computer to emit the odor.

The auxiliary transducers 332 and 336 may be part of the portable computer or they may be external to the computer (e.g. part of the shell). The microphone 328 and the transducers 332 and 336 are shown in phantom as these devices are not needed for some of the subscription services described below. In addition, although not shown in phantom, the speaker 320 and DAC 318 are also optional.

In operation with an exemplary subscription service, the processor 310, under control of a program stored in the memory 312, accesses the host computer 120 through the modem using either the telephone jack 316 or the cellular transceiver 322. Upon connecting with the host computer 120, a minimal browser in the portable computer is activated. The browser identifies the portable computer to the host computer 120, for example by exchanging internet "cookies." Using this identification, the host computer determines any subscription services to which the portable computer is registered and whether the latest update to the subscription has been transmitted to the portable computer. If any subscription service needs to be updated, the host computer 120 transfers the data and/or program code to the portable computer. The exemplary portable computer assigns each subscription service a memory area within the memory 312. In addition to the identity of the portable computer, the exemplary subscription service knows the hardware configuration and operating system of the portable computer.

Any update for the portable computer is configured to be compatible with the particular hardware configuration and operating system of the identified portable computer. This may be accomplished by the portable computer sending a map of memory locations assigned to the subscription service with the identification information or by a program in the portable computer monitoring information received from the subscription service and routing the received information to appropriate memory locations depending on whether it is program code or data. After updating the subscription services, or if the portable computer is not registered for any subscription service, the host computer 120 provides a menu listing the services that are available. If the user selects one of these services, the process repeats to provide the first and/or current installment of the newly selected service.

Figure 4:
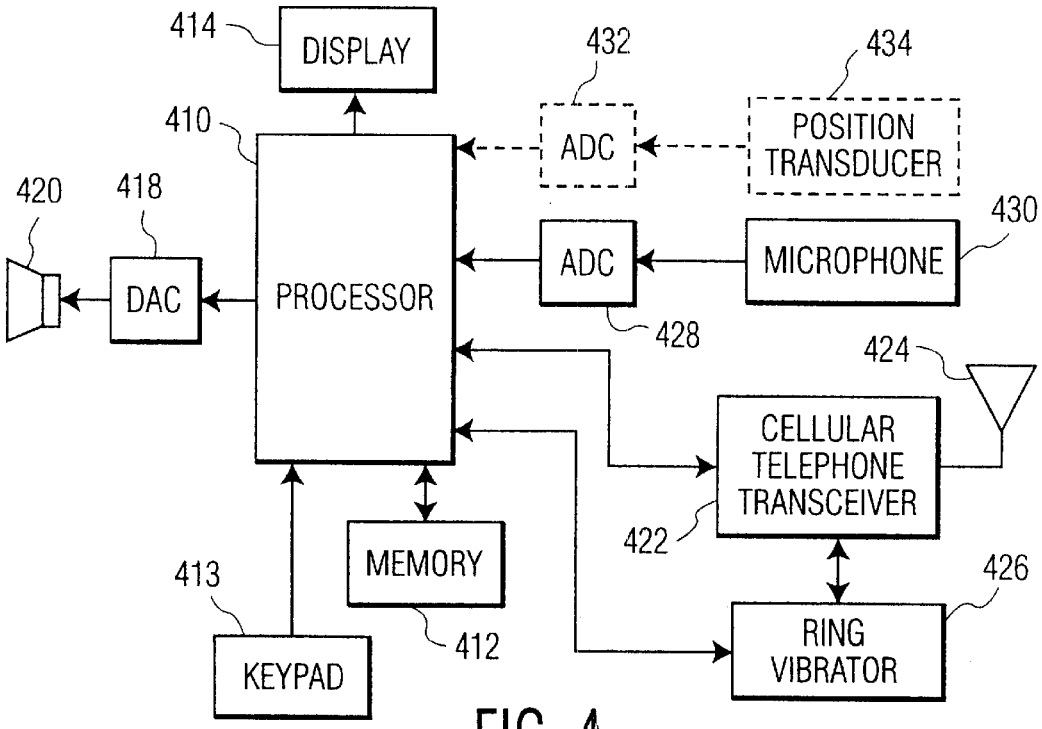
FIG. 4 is a functional block diagram of a portable computer that may be used in others of the embodiments of the invention shown in FIG. 1.

FIG. 4 is a functional block diagram of an exemplary portable computer that is implemented in a cellular telephone. As with the embodiment described with reference to FIG. 3, the portable computer shown in FIG. 4 includes a processor 410, memory 412, display device 414 and keypad 413. In this embodiment of the invention, the keypad may include a power button, the standard 12 key telephone keypad, a menu/menu select key, and up and down menu scrolling buttons. As the portable computer shown in FIG. 4 is a cellular telephone, it also includes a microphone 430, ADC 428, DAC 418 and speaker 420. These devices are used as the mouthpiece and earpiece of the telephone. In addition, the telephone includes a cellular telephone transceiver 322 and ringer 426. As is well known, the ringer may be a vibrating ringer that may be, for example, a part of the battery (not shown) that powers the cellular telephone.

As shown in FIG. 4, the exemplary telephone may include an auxiliary transducer, for example, a position sensing device 434, such as an accelerometer, and an ADC 432 that digitizes information provided by the transducer 434 and applies it to an input port of the processor 410.

Figure 5:
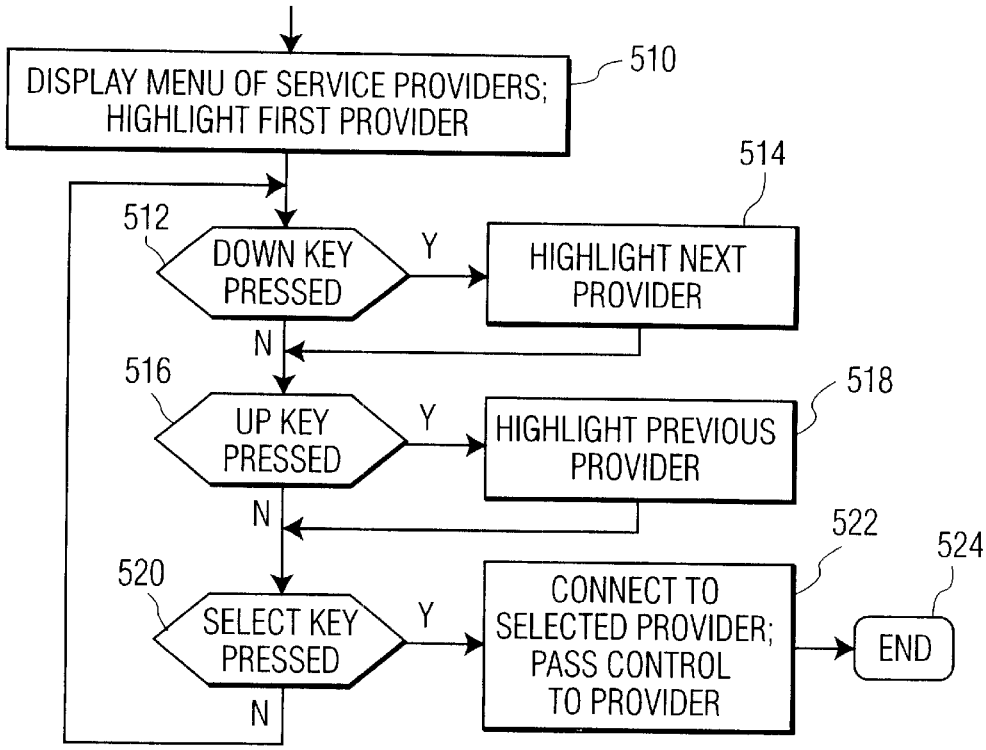
FIGS. 5 and 6 are flow-chart diagrams that are useful for describing the operation of a portable computer which includes an embodiment of the invention.
Figure 6:
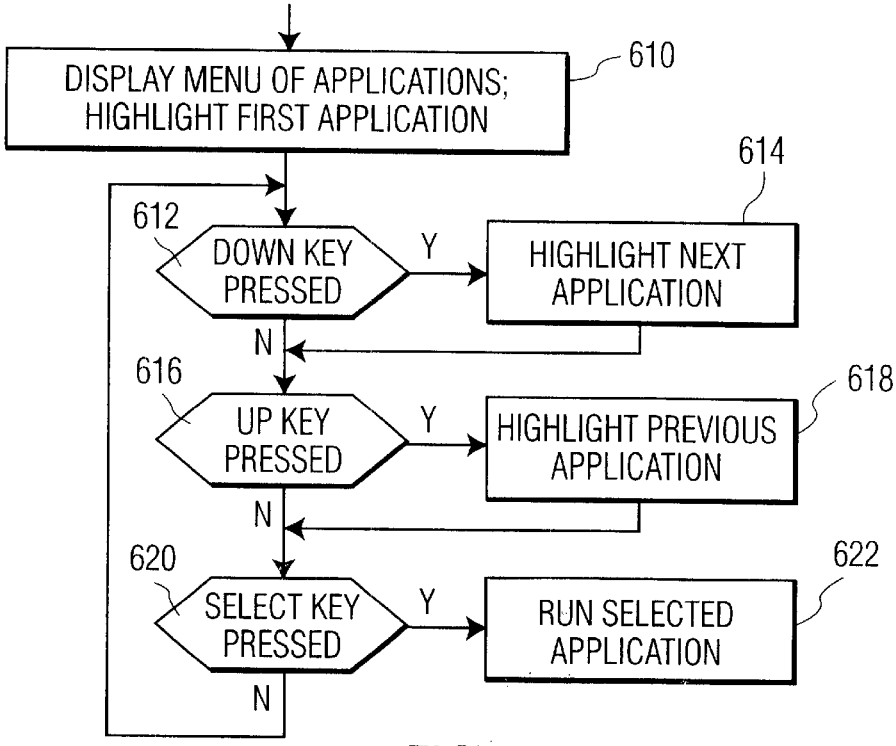
Figure 7A:
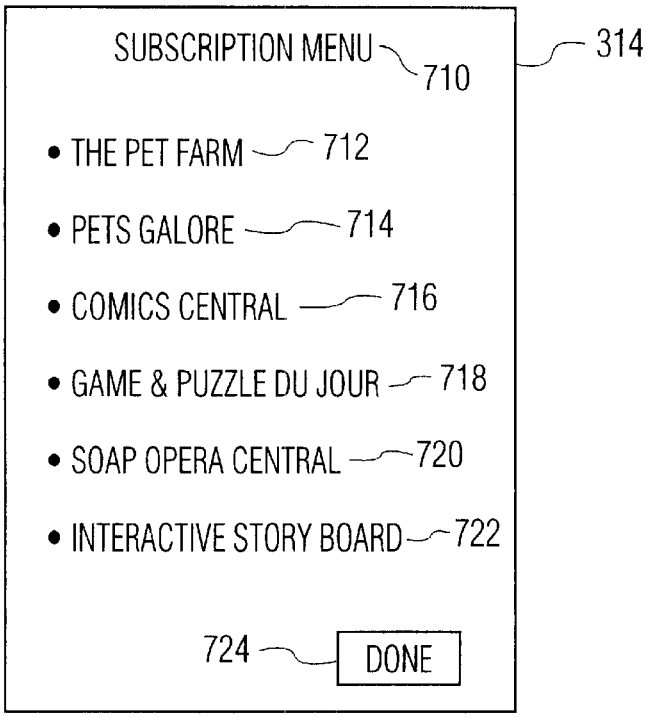
FIGS. 7A, 7B, 7C and 7D are screen diagrams that are useful for describing the operation of a portable computer which executes processes illustrated by the flow-chart diagrams shown in FIGS. 5 and 6.

FIGS. 5 and 6 are flow-chart diagrams that show exemplary control functions that may be implemented in the portable computer to access and use the subscription services. The first step in FIG. 5, step 510, displays a menu of service providers and highlights the first provider. An exemplary subscription menu, identified by the legend 710, is shown in FIG. 7A. As shown in this Figure, a user may choose from among two virtual pet subscription services 712 and 714, a service for games and puzzles 718, a service 720 that provides updates on television soap operas and an interactive story board service 722 that allows a user to customize a story by directing its plot line(s).

Returning to FIG. 5, at step 510, the entry 712 for The Pet Farm is initially highlighted. If, at step 512, the user presses the scroll down key, then, at step 514, the portable computer highlights the next entry in the menu, in this case, the entry for the Pets Galore service. If the user did not press the scroll down key at step 512 or after step 514, step 516 determines if the user has pressed the scroll up key. The exemplary process employs a wrap-around menu system. Consequently, if at step 516, the entry for The Pet Farm is highlighted, when the scroll up key is pressed, the next entry highlighted at step 518 is the entry for the Interactive Story Board. After step 518, or after step 516 if the scroll up key is not pressed, the process executes step 520 to determine if the select key has been pressed. If, at step 520, the select key has been pressed, then the process transfers control to step 522 which connects the portable computer to the selected service provider and passes control to the provider. This may be done, for example, by dialing an internally stored access number for the selected service and activating the minimal browser in the portable computer to display the specially formatted web pages provided by the host computer 120.

As an alternative to pressing the select key, the user may press the DONE button 724 on the display screen. This assumes that the display screen is also a touch sensitive input device.

Rather than receiving the subscriptions and updates from the host computer 120, a portable computer such as the PDA 110 or modular portable computer 116 may connect to the host computer 120 as a service provider on the global information network and request a desired web site, corresponding to the selected subscription service provider, using the standard protocols of the global information network. Once connected to the desired subscription service provider, the process shown in FIG. 5 passes control to the provider to select new subscriptions or receive updates of existing subscriptions, as described in more detail below, with reference to FIGS. 8, 9 and 10.

In a second alternative embodiment of the invention, specially suited for the cellular telephone portable computer 112, the step 522 connects to the host computer 120 and, optionally, to the global information network, via the cell transceiver 124 and head end processor 126 of the cellular telephone system. This connection does not require any dialing as the cellular telephone is in communication with the cell transceiver soon after it is turned on. When used with one exemplary subscription service, no action by the user is needed to update existing subscriptions. The head end processor 126 of the cellular telephone system may do this automatically when the telephone 112 is powered on and registered into the network. This may be done, for example, by using the identifying information sent as a part of the registration signal, to access a list of active subscriptions and then determining if updated for all of these services had been successfully sent to the telephone 112 in earlier transmissions.

When the user selects a particular service at step 524 and is connected, the process continues under control of the service provider, as described below with reference to FIGS. 7B through 10. After the user has received updates of any existing or new subscriptions, control is returned to the portable computer and the process ends at step 524.

FIG. 6 is a flow-chart diagram showing an exemplary process by which the user may select and use one application from among several applications that have been downloaded or updated by the remote service provider. The first step 610 displays a list of available applications and highlights the first application in the list. Using the steps 612, 614, 616 and 618, the user may scroll through the list until a desired application is highlighted. When, at step 620, the user presses the select key, the portable computer executes the highlighted application.

Several exemplary subscription applications shown in FIGS. 7A, 7B, 7C and 7D. These include virtual pets, comics, games and puzzles, soap opera summaries and interactive stories. A subscription account may be provided, for example at the host computer 120 which establishes a secure link between the host computer and the portable computer and then prompts the user to enter a credit card number. If a the remote computer is a cellular telephone, the user may be prompted to add the charges directly to the cellular telephone account. Alternatively, it is contemplated that the programs and update data may be provided free of charge as a loss-leader to promote other services.

The programs and data downloaded by these services may operate as follows. The inventors contemplate two types of pets, a Tamagotchi-type pet that resides entirely within the portable computer and a pet that controls a robot to which the portable computer is linked. The difference between a Tamagotchi-type pet according to the present invention and a conventional Tamagotchi pet is that the pet used with the present invention may be updated or even changed to an entirely different pet. Rather than being limited to fixed graphics stored in an existing program, the pet may be updated to use entirely different graphics and an entirely different program. Thus, a female cat could become pregnant, gestate her young over several weeks and give birth without needing the entire program stored on the portable computer at any one time. Different programs reflecting different programs may be stored into the portable computer to emulate the behavior of the cat prior to, during and after her pregnancy.

A robot pet subscription may program the portable computer to control a robot implemented as a shell for the computer. These changes may emulate pet behaviors that change over time to reflect stimuli to which the virtual pet have been have been exposed. If, for example, a pressure sensor in the robot's foot indicates that the foot has been subject to heavy pressure, the updated program may cause the robot to limp, favoring that foot. Alternatively, a cat pet robot that has been kept in the dark may snarl and caterwaul when exposed to bright lights. This behavior may change over time. The remote computer may know the stimuli to which the robot pet have been subject for example, by reading a sensor log file (not shown) that is maintained in the memory of the portable computer.

A comics subscription and a soap opera update subscription operate more simply by automatically providing a user with new comic strips or plot summaries for selected titles each day. A user having a cellular telephone portable computer 112 may, for example, receive updates for the selected titles as soon as the telephone is turned on each morning. He or she may then view the strips one frame at a time on the display device 112A or may scroll through text summaries of the soap opera plots. In this embodiment, to minimize memory usage, the host processor may download comic strip frames one at a time, not downloading the next frame until the current frame has been read. In a PDA environment, the PDA may download updates to specified titles responsive to a request from the user or automatically, for example, when the PDA is synchronized with the user's personal computer or when it connects to the global information network.

A games and puzzle subscription operates in much the same way as a comics subscription. A user may select, for example, crossword puzzles or a game of the day. The selected item would then be downloaded automatically each day, possibly deleting the previously downloaded game or puzzle. The application list shown on the portable computer would then be updated to show the latest puzzle and/or the new game. The user would access the new puzzle or game in the same way that a preprogrammed or manually downloaded puzzle or game is accessed. The puzzle and game obtained through the subscription service automatically change with only minimal effort required from the user, once the user has requested the subscription service.

An interactive story board may, for example, allow a user to select a particular type of story, for example, a romance, a mystery or an action-adventure story. Each day, the service may provide a new installment and then asks the user specific questions that will guide the plot line(s) for future installments. Thus, a user can customize a story to his or her own preferences. Alternatively new installments may be provided only when the user has finished reading the current installment.

The subscription services described above are only exemplary. It is contemplated that other types of programs that benefit from being updated on a subscription basis may also be used. The advantages gained by updating the programs on a subscription basis are to allow more sophistication in the program than could be implemented using the limited program storage in the portable computer by selectively downloading only a portion of the total program at any one time. In addition, any analysis needed to interpret and respond to interrelated stimuli may be done using the host computer and need not be implemented in the portable computer. Furthermore, any one portable computer may use multiple subscription services. A PDA-type portable computer 110 may operate under fixed programming as a PDA and include a subscription to a robot pet and multiple comic strips. When used as a robot pet, the PDA may, for example, be inserted into a cat robot which may purr and occasionally stretch in response to petting stimulus.

Figure 7B:
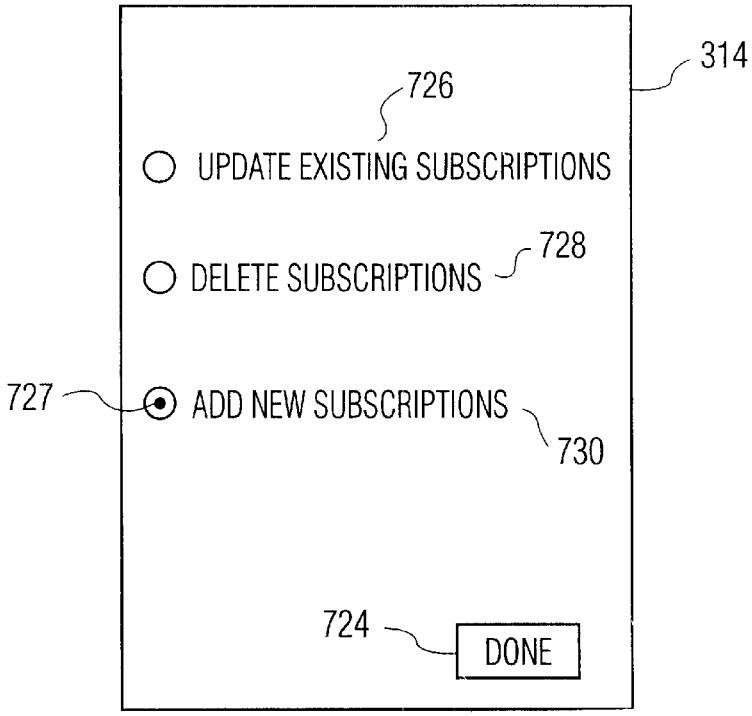
Figure 7C:
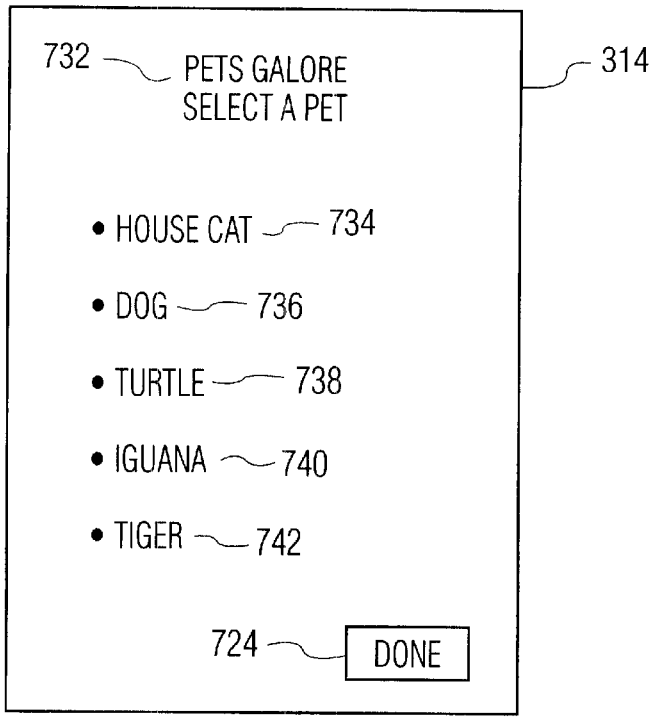
Figure 7D:
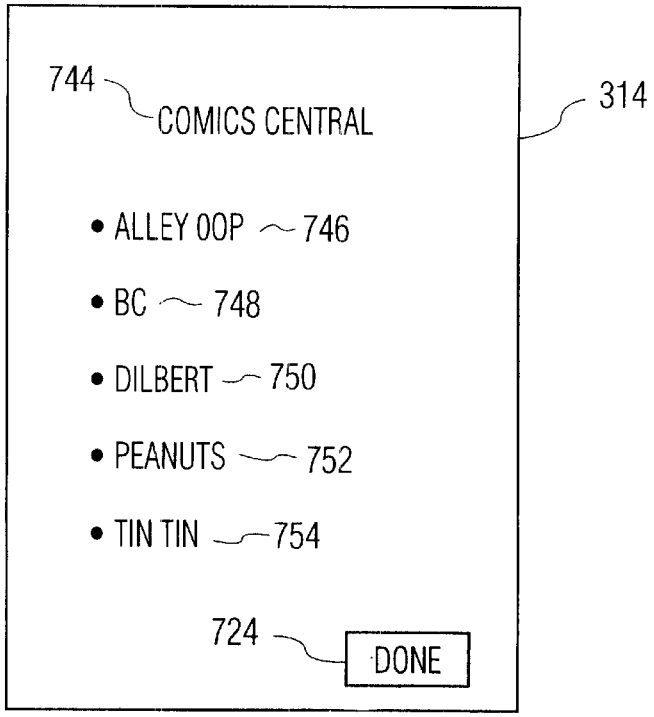

FIGS. 7B, 7C and 7D show menus that are displayed on the portable computer while it is under control of the host computer 120 or web site. The menu shown in FIG. 7B may be the first menu displayed when the user connects to the web site. The name 725 of the site is displayed at the top of the screen. This menu provides three choices to the user: update existing subscriptions 726, delete subscriptions 728 or add new subscriptions 730. In this exemplary screen, the user may select only one of these actions using the radio buttons 727. Once the appropriate radio button has been pressed, the user may press the select key or engage the DONE button 724 to signal the action to the subscription provider.

In the sample screen shown in FIG. 7B, the user has asked to add new subscriptions in the Pets Galore web site. In response to this request, the subscription provider displays a menu as shown in FIG. 7C, that displays the types of pet subscriptions which are available. The exemplary display lists a house cat 734, a dog 736, a turtle 738, an iguana 740 and a tiger 742. The user highlights one or more of these selections using the scroll keys and the select keys and then indicates an end to the selection process. This may be done, for example, by pressing the select key twice in rapid succession or by engaging the DONE button 724 on the touch-sensitive display device, as described above. The subscription service provider downloads the base program (s) and any current updates for the selected pet(s).

FIG. 7D shows a sample screen that may be displayed if the user had selected the Comics Central web site in FIG. 7A and then the Add New Subscriptions selection in FIG. 7B. As shown in FIG. 7D, the subscription service provider displays a list of available comic strips to which the user may subscribe. In this exemplary embodiment of the invention, the available strips are Alley Oop™ 746, BC™ 748, Dilbert™ 750, Peanuts™ 752 and Tin Tin™ 754. As described above, once the user has highlighted or otherwise indicated selection of one or more titles from among the listed titles, the subscription service provider records the selection, associated with a unique identifier for the portable computer. When, at a later date, the user accesses the Comics Central web site, the service provider automatically updates the comic strips either downloading graphics and text for every frame of the strips or, as described above, downloading one frame at a time as it is read by the user.

Figure 8:
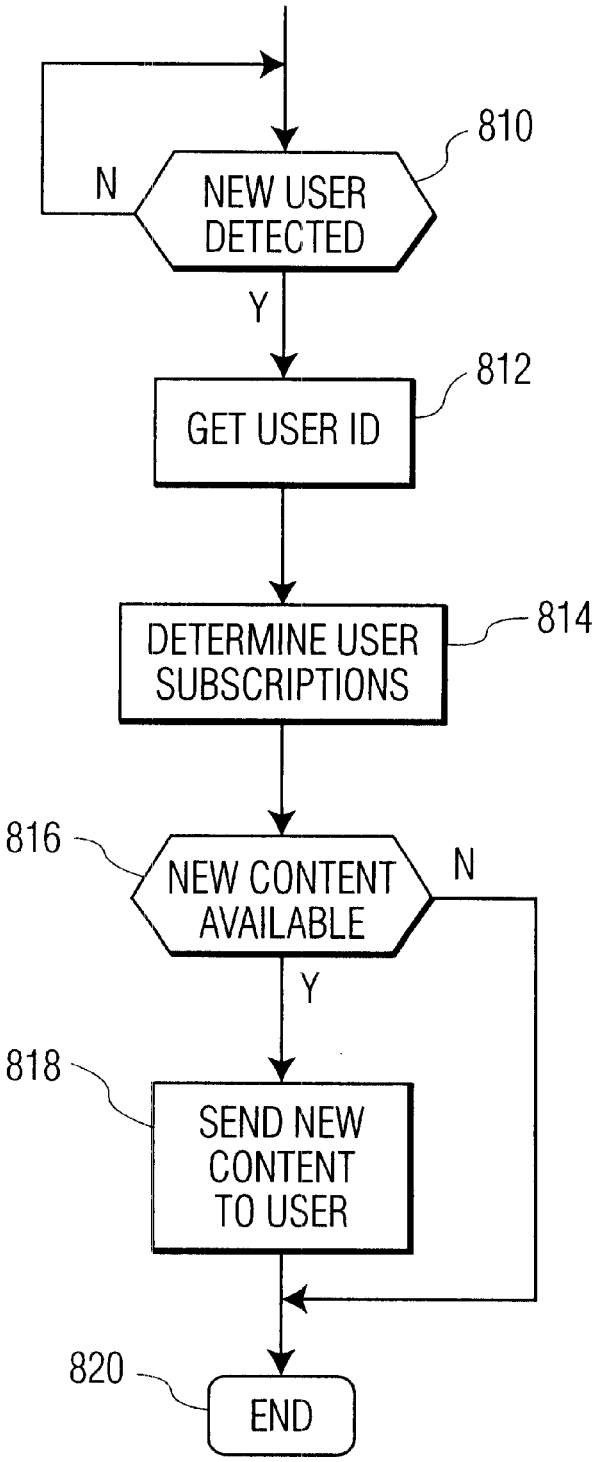
FIGS. 8, 9 and 10 are flow-chart diagrams that are useful for describing the operation of a subscription service that may be used with an embodiment of the present invention.
Figure 9:
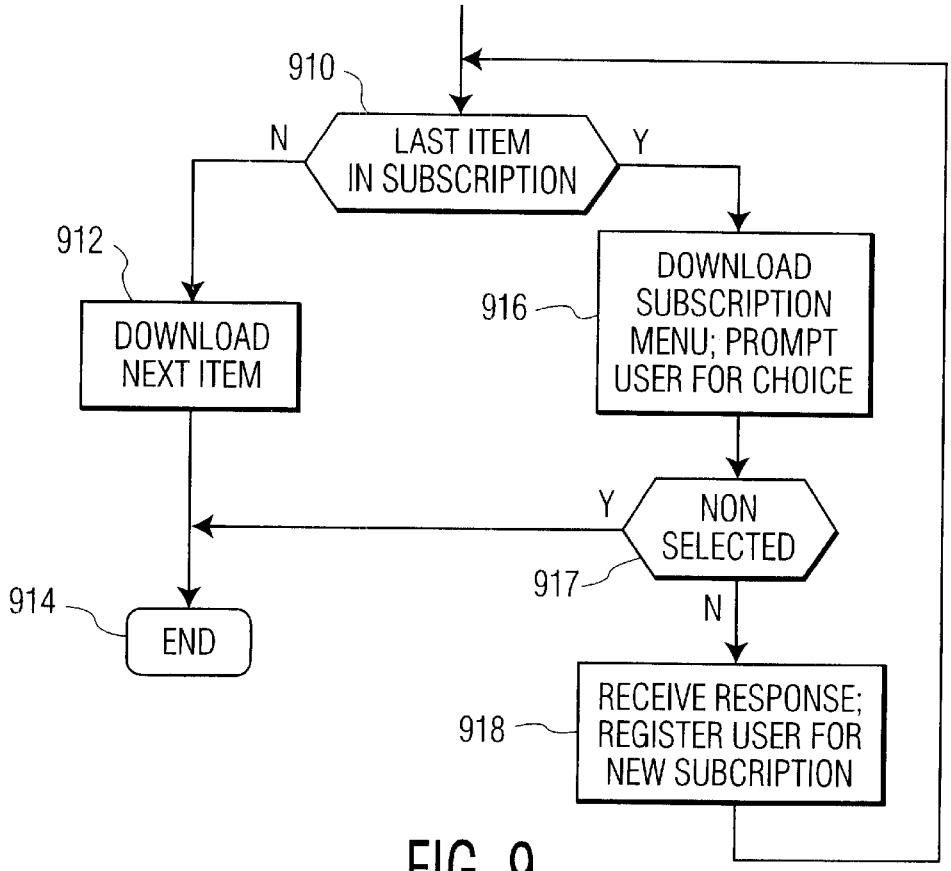
Figure 10:
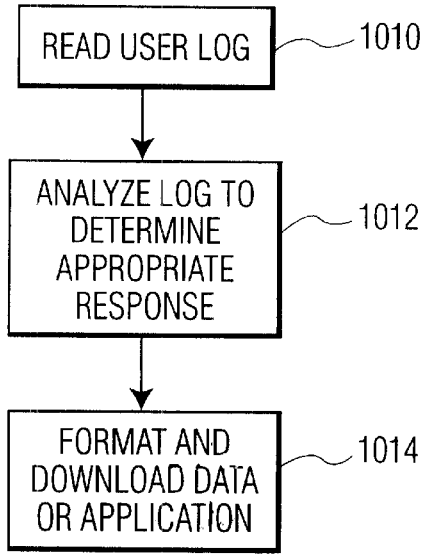

FIGS. 8, 9 and 10 are flow-chart diagrams that illustrate exemplary processes which may be performed by a service provider. The flow-chart diagram shown in FIG. 8 illustrates steps that may be taken when a user having existing subscriptions logs on to the web site of a subscription service provider. At step 810, the process detects that a new user has logged on. Next, at step 812, the process obtains the unique identifier from the user. This identifier may be provided, for example as an internet "cookie." Alternatively, the service provider may assign the identifier to the user when the user first registers with the service and send a command to the portable computer that causes the computer to return the assigned identifier with each subsequent registration. Also at step 812, the subscription service may obtain other information from the portable computer including the type of computer, the operating system that controls the computer and the current configuration of the subscription memory. This configuration may include, for example, a map of memory locations containing program code and data assigned to each application, and the location of the map of entry points into that program code and data. In this exemplary embodiment of the invention, each subscription service manages the memory within its allotted region of the portable computer memory. In this instance, each application downloaded by the subscription service may be an image of the allocated area that is maintained by the host computer 120.

Alternatively, the memory management may be done by the portable computer. In this embodiment of the invention, the subscription service may identify each item being sent to the portable computer as being program code or data and provide a table of entry points. The portable computer then stores each item appropriately and translates the table of entry points into the addresses that are actually used to store the program code and data.

After step 812, step 814 uses the unique identifier to determine the active subscriptions for the user. At step 816, the process determines if new content is available for any of these subscriptions. If there is, then step 818 is executed which downloads the new content to the memory of the portable computer. After step 818 or after step 816 if no new content is available, the process ends at step 820.

FIG. 9 shows details of the Send New Content To User step 818 of FIG. 8. In the exemplary embodiment of the invention, it is assumed that when a user signs up for a subscription he or she pays for a limited number of updates. At step 910 the process determines if the last item in the subscription has been provided. If so, then at step 916, the process downloads the subscription menu and prompts the user to choose to continue the subscription or select a new subscription. If at step 917, the process determines that the user has not selected a new subscription, then the process ends at step 914. If the user selects one or more new subscriptions at step 917, then, at step 918, the process registers the selection and automatically debits the user's account for the next set of updates for each of the selected subscriptions. After step 918, the process branches to step 910, described above. If, at step 910, it is determined that the user may access additional items, control transfers to step 912 which downloads the next item. The process ends at step 914.

FIG. 10 is a flow-chart diagram which shows details of the Download Next Item step of FIG. 9. The first step in this process, step 1010 reads the user log. As described above, this log records stimuli to which the portable computer have been subject or control data has that been entered since the last update. After downloading the log at step 1010, the process analyzes the log to determine an appropriate response. In the exemplary embodiment of the invention, the analysis that is performed may be complex, analyzing and correlating multiple stimuli. Once the stimuli and control data have been analyzed and an appropriate update response has been determined at step 1012, the update is downloaded to the portable computer at step 1014. Steps 1010 and 1012 may be used for different purposes in the different subscription types. In a virtual pet subscription, as described above, the log may provide information on how the pet has been handled since the last update. For a comic subscription or a soap opera update, the log may provide information on the order in which the strips were read, causing the service provider to change the order in which they are provided. For a puzzle or game subscription, the log may indicate the user's ability to solve a particular puzzle or play the game allowing the subscription provider to increase or decrease the difficulty of the next puzzle or game that it provides. For an interactive story subscription, the log may contain the user preferences requested during the previous installment.

While the invention has been described in terms of multiple exemplary embodiments, it is contemplated that it may be practiced as described above within the scope of the attached claims.

What is claimed is:

1. A portable computer configured to be coupled to receive a subscription service, comprising:

a processor;

data communications apparatus, coupled to the processor, the data communications apparatus being configured to establish a connection with at least one subscription service;

means for transferring data to the subscription service to identify the portable computer to the subscription service;

means for registering the portable computer to receive at least one subscription from the at least one subscription service;

a memory, coupled to the processor and the data communications apparatus, the memory being configured to automatically receive at least one application of a plurality of applications, determined by the at least one subscription service, the at least one application including base program code and periodic updates thereto for the at least one subscription registered to the portable computer; and actuator means, coupled to the processor;

wherein the processor is configured to execute the at least one application from the memory, responsive to the actuator means, independently of the subscription service.

2. A portable computer according to claim 1, further including a plurality of connectors configured to be connected to a respective plurality of sensors, the sensor connectors providing input data to the at least one application.

3. A portable computer configured to be coupled to receive a subscription service, comprising:

data communications apparatus which establishes a connection with at least one subscription service;

means for transferring data to the subscription service to identify the portable computer to the subscription service; and means for registering the portable computer to receive at least one subscription from the at least one subscription service;

a memory which automatically receives at least one application of a plurality of applications, determined by the at least one subscription service, the at least one application including base program code and periodic updates thereto for the at least one subscription registered to the portable computer;

a plurality of connectors configured to be connected to a respective plurality of sensors, the sensor connectors providing input data to the at least one application;

a log file into which the portable computer records information from the plurality of sensors, and other information entered into the portable computer; and means for transmitting the log file from the portable computer to the at least one subscription service for use by the subscription service in providing the periodic updates of the application to the portable computer.

4. A portable computer according to claim 1, further including a shell representing one of a character and an object associated with the at least one application, wherein the portable computer is configured to fit within the shell.

5. A portable computer according to claim 2, further including a shell representing one of a character and an object associated with the at least one application, wherein the portable computer is configured to fit within the shell, and the shell includes a plurality of sensors coupled to a respective plurality of interface ports that mate with respective ones of the plurality of connectors of the portable computer.

6. A portable computer according to claim 1, further including a cellular telephone transceiver that couples the portable computer to the at least one subscription service through a cellular telephone network such that the at least one subscription service is automatically accessed when the cellular telephone is registered with the network.

7. A portable computer according to claim 1, wherein the at least one subscription service is selected from a group consisting of a comic strip, a virtual pet, a puzzle, a continuing narrative, and an interactive narrative.

8. A portable computer according to claim 1, further including a telephone jack that couples the portable computer to the at least one subscription service through a telephone network.

9. A portable computer according to claim 1, further including a position sensing device that provides positional data to the portable computer for use with the at least one subscription service.

10. A portable computer according to claim 2, further including a further plurality of connectors configured to be connected to a respective plurality of transducers and actuators which are controlled by the at least one application.

11. A portable computer according to claim 4, further including a further shell representing a character or object different from the character or object represented by the shell, and a further application associated with the further shell, the further application being different from the application, wherein the portable computer is configured to fit within the shell or the further shell.

12. A portable computer according to claim 5, wherein at least one of the plurality of sensors is specific to the shell and to the application associated with the shell.

13. An electronic updateable virtual pet comprising:

A portable computer configured to be coupled to receive a subscription service, comprising:

data communications apparatus which establishes a connection with at least one subscription service;

means for transferring data to the subscription service to identify the portable computer to the subscription service; and a memory which automatically receives at least one application of a plurality of applications, determined by the at least one subscription service, the at least one application including base program. code and periodic updates thereto for the at least one subscription registered to the portable computer;

a plurality of sensors, coupled to the portable computer to provide input signals to the one application;

a plurality of actuators and transducers, coupled to the portable computer to be controlled by the at least one application according to a predetermined algorithm; and a sensor log which records input signals provided by the plurality of sensors, the sensor log being provided to the subscription service by the means for transferring data;

wherein the subscription service, responsive to the sensor log, provides the periodic updates to the at least one application to change the predetermined algorithm in response to the sensor log.

14. The portable computer of claim 1, wherein said actuator means includes means to control said portable computer.

15. The portable computer of claim 1, wherein said actuator means includes selection means operable to select the at least one application.

* * * * *

UNITED STATES PATENT AND TRADEMARK OFFICE

CERTIFICATE OF CORRECTION

PATENT NO. : 6,494,762 B1
DATED : December 17, 2002
INVENTOR(S) : Dennis Bushmitch et al.

It is certified that error appears in the above-identified patent and that said Letters Patent is hereby corrected as shown below:

Title page,
Item [73], Assignee, "Matsushita Electrical Industrial Co., Ltd." should read
-- Matsushita Electric Industrial Co., Ltd. --.

Signed and Sealed this

Thirteenth Day of January, 2004

JON W. DUDAS
*Acting Director of the United States Patent and Trademark Office*